US008263910B2

(12) United States Patent
Chiu

(10) Patent No.: US 8,263,910 B2
(45) Date of Patent: Sep. 11, 2012

(54) HEATER

(75) Inventor: Ming-Tsung Chiu, Chung-Ho (TW)

(73) Assignee: New Widetech Industries Co., Ltd., Chung-Ho (TW)

( * ) Notice: Subject to any disclaimer, the term of this patent is extended or adjusted under 35 U.S.C. 154(b) by 360 days.

(21) Appl. No.: 12/755,716

(22) Filed: Apr. 7, 2010

(65) Prior Publication Data

US 2011/0248016 A1 Oct. 13, 2011

(51) Int. Cl.
*H05B 3/02* (2006.01)
*B23K 13/08* (2006.01)

(52) U.S. Cl. ..... 219/477; 219/476

(58) Field of Classification Search ..... 219/476, 219/477

See application file for complete search history.

(56) References Cited

U.S. PATENT DOCUMENTS

| | | | | |
|---|---|---|---|---|
| 7,930,071 | B2 * | 4/2011 | Nishizawa et al. | 700/304 |
| 2002/0150478 | A1 * | 10/2002 | Aoki | 417/44.1 |
| 2005/0142999 | A1 * | 6/2005 | Uemura | 454/152 |
| 2006/0182429 | A1 * | 8/2006 | Shapiro et al. | 392/365 |
| 2006/0278086 | A1 * | 12/2006 | Inagaki et al. | 96/223 |
| 2009/0009967 | A1 * | 1/2009 | Nishizawa et al. | 361/695 |
| 2009/0148141 | A1 * | 6/2009 | Shapiro et al. | 392/367 |

* cited by examiner

*Primary Examiner* — Nitin Parekh
(74) *Attorney, Agent, or Firm* — C. G. Mersereau; Nikolai & Mersereau, P.A.

(57) ABSTRACT

A heater has an outer casing and at least one core assembly. An air inlet is formed through a rear surface of the outer casing. Two air outlets are formed respectively through two sides of the outer casing. Each core assembly is mounted in the outer casing and has at least one fan and two heating assemblies. Each fan draws air axially from the air inlet and blows air radially towards the air outlets. The heating assemblies are mounted respectively in the sides of the outer casing and correspond respectively to the air outlets. With such positioning of the air inlet and the air outlets of the outer casing, and with the fan drawing air axially and blowing air radially, the warm air blows out from both sides of the outer casing. Thus, convection speed is increased and ambient air temperature is warmed more effectively.

8 Claims, 8 Drawing Sheets

HEATER

BACKGROUND OF THE INVENTION

1. Field of the Invention

The present invention relates to a heater, especially to a heater used for raising ambient air temperature.

2. Description of the Prior Arts

Heaters are electronic devices that are generally used for raising ambient air temperature. A conventional heater has at least one axial flow fan and a heating assembly to draw air through a backside of the heater and blow warm air through the front side of the heater. Thus, the warm air is blown in single direction only. Because convection of warm air is in a single direction, warming of ambient air temperature is slow. Therefore, the conventional heater must be run before a warming effect is felt so is inconvenient and requires high power consumption.

To overcome the shortcomings, the present invention provides a heater that could increase the convection speed and accelerate the raise of the ambient air temperature to mitigate or obviate the aforementioned problems.

SUMMARY OF THE INVENTION

The main objective of the present invention is to provide a heater that increases convection speed so accelerates warming of ambient air temperature. The heater comprises an outer casing and at least one core assembly. The outer casing has an air inlet and two air outlets. The air inlet is formed through a rear surface of the outer casing. The air outlets are formed respectively through two sides of the outer casing. Each core assembly is mounted in the outer casing and has at least one fan and two heating assemblies. Each fan draws air axially from the air inlet of the outer casing and blows air radially towards the air outlets of the outer casing. The heating assemblies are mounted respectively in the sides of the outer casing and correspond respectively to the air outlets.

With such positioning of the air inlet and outlets and with the fan exhaling air radially, the warm air is blown out from both sides of the outer casing. Thus, convection speed is increased and warming of ambient air temperature is accelerated, which increases the efficiency of heating ambient air. Furthermore, because many core assemblies are stacked on one another, heating area can be increased.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
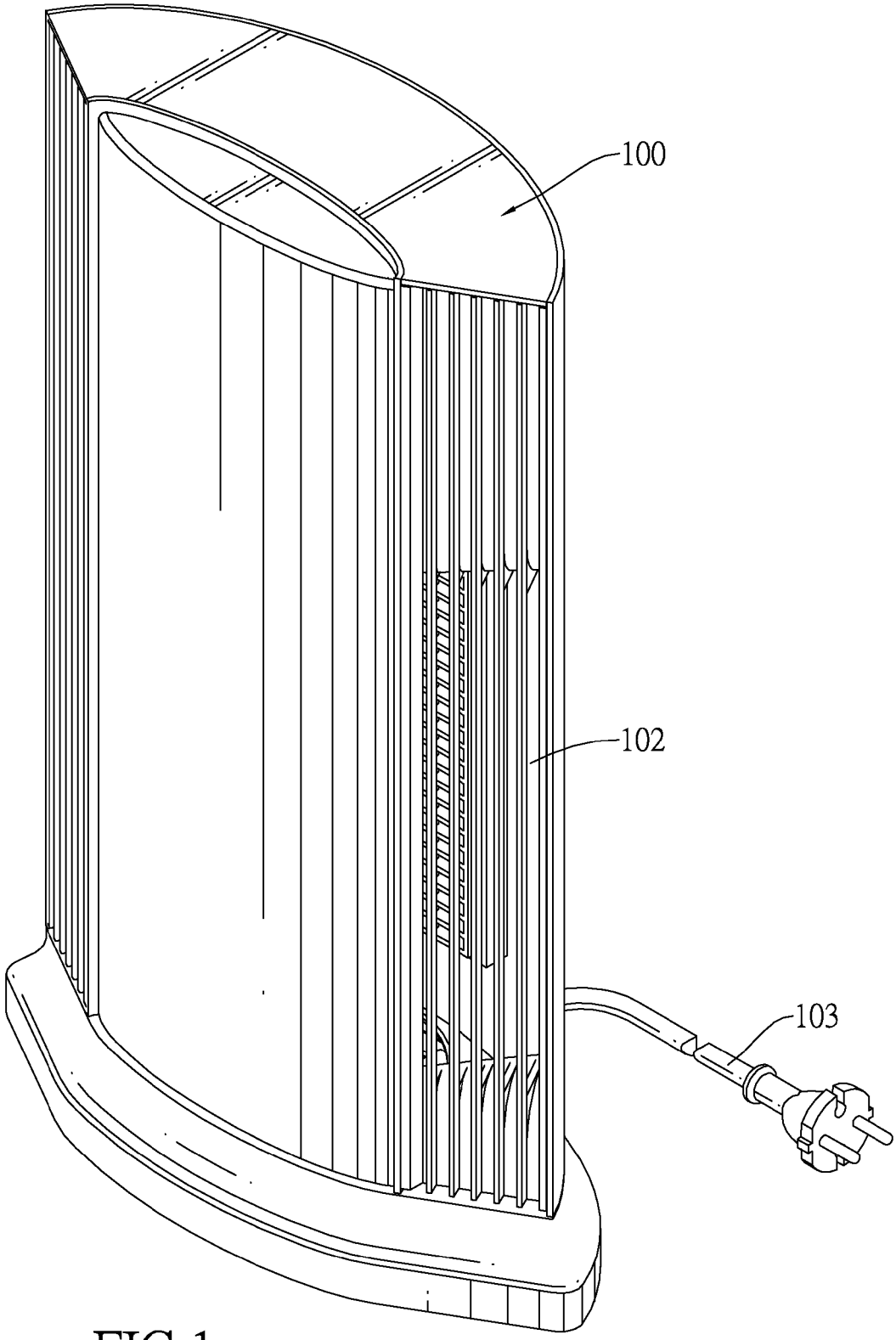
FIG. 1 is a perspective view of a heater in accordance with the present invention.
Figure 2:
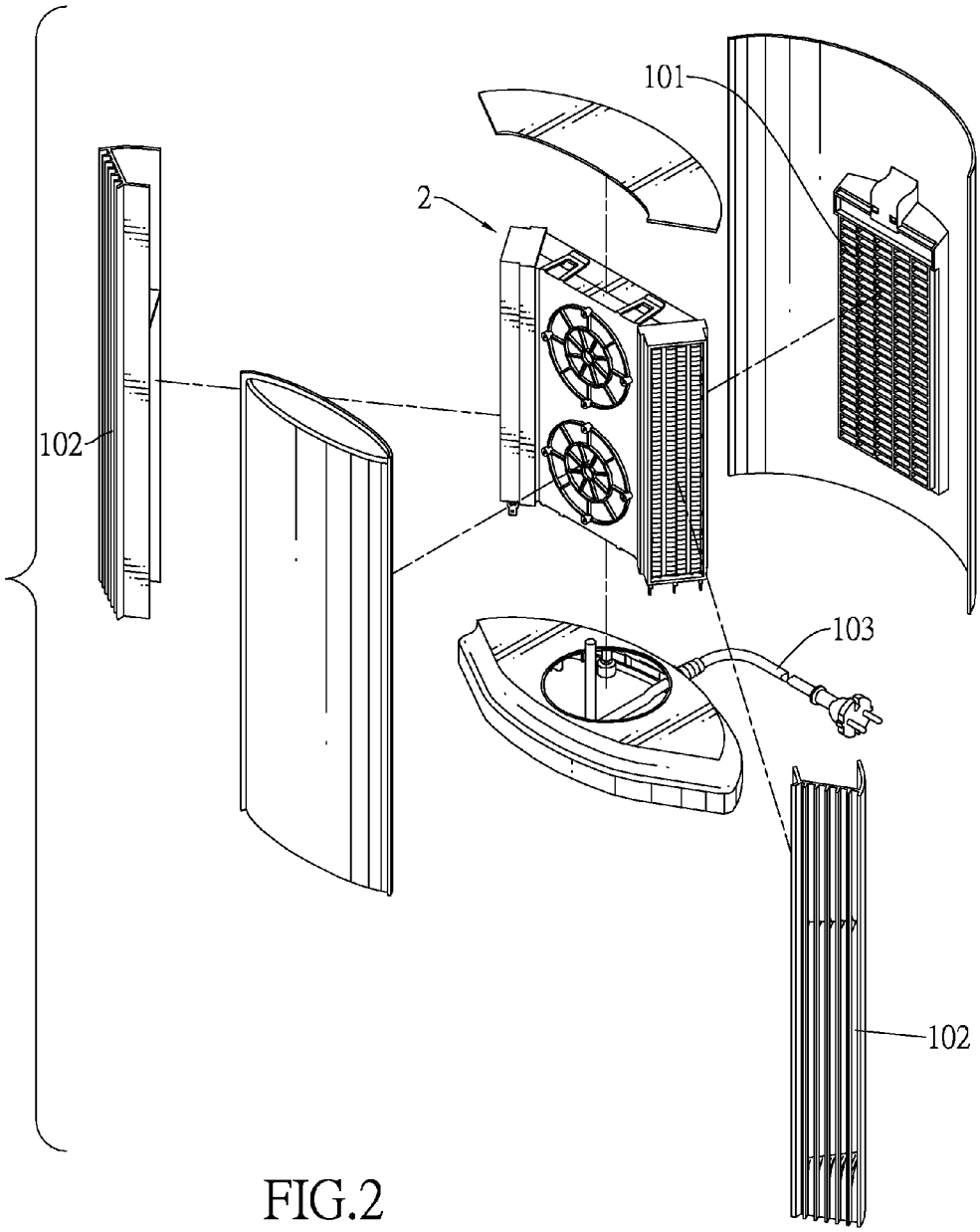
FIG. 2 is an exploded perspective view of the heater in FIG. 1.
Figure 3:
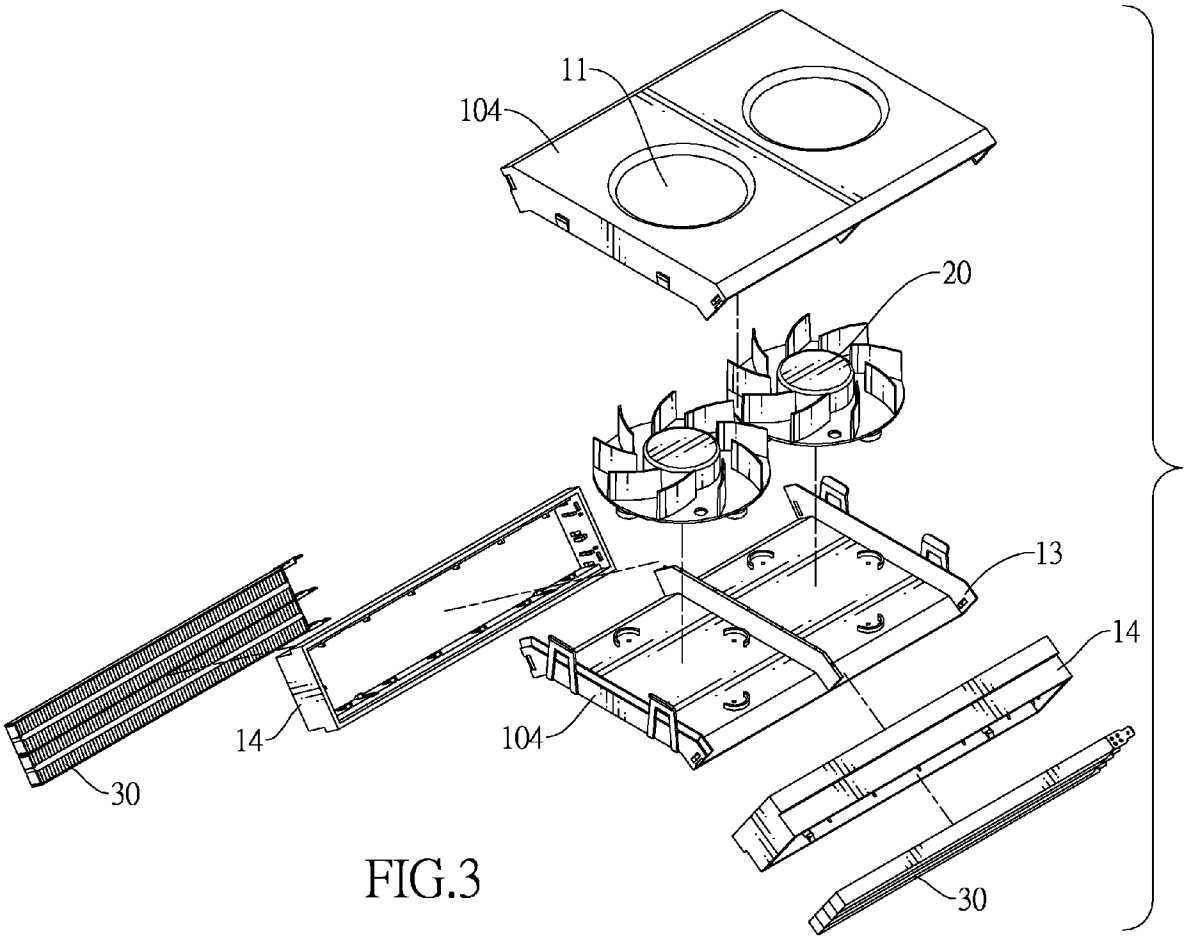
FIG. 3 is an exploded perspective view of a core assembly of the heater in FIG. 1.
Figure 4:
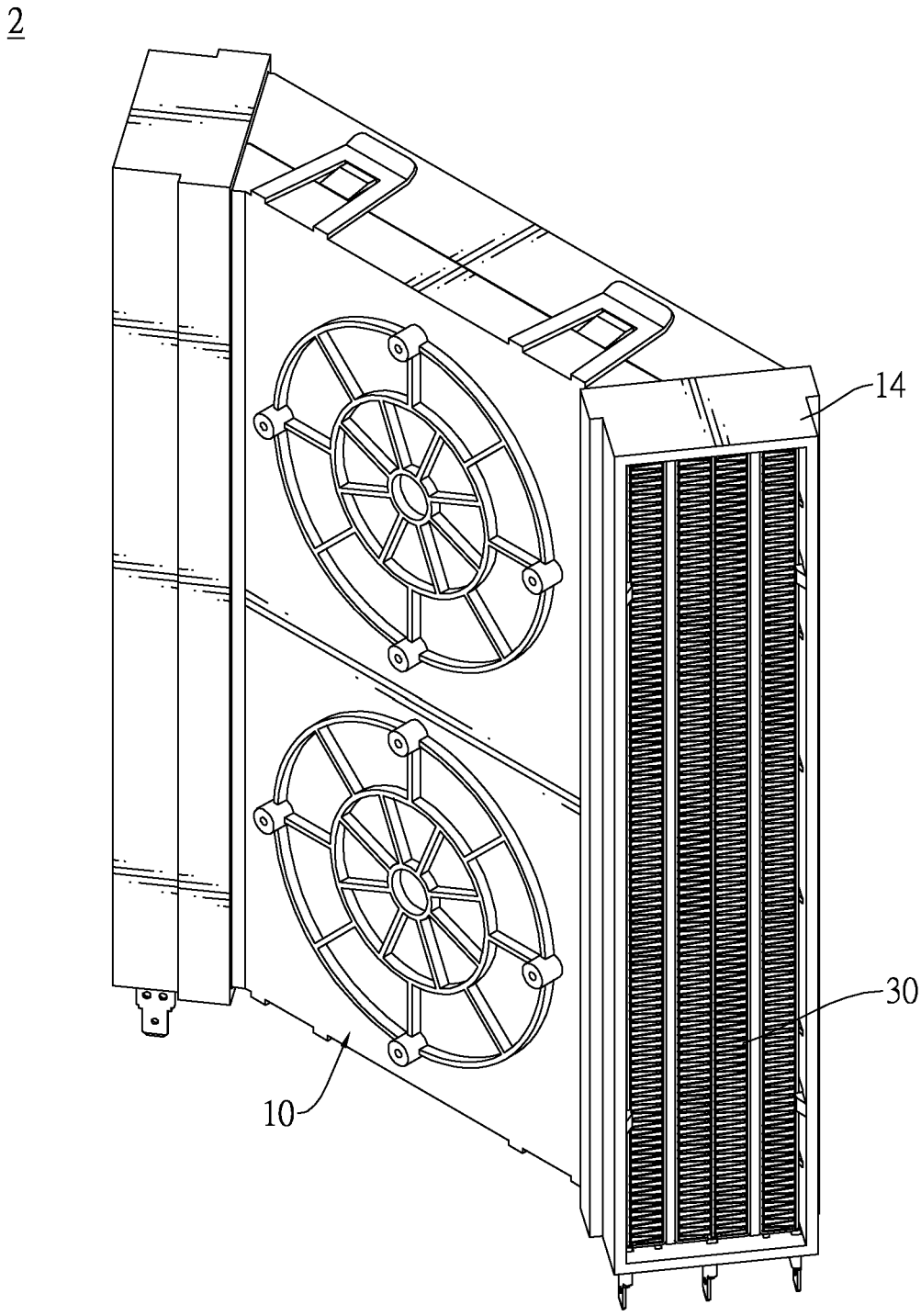
FIG. 4 is a perspective view of the core assembly in FIG. 3.
Figure 5:
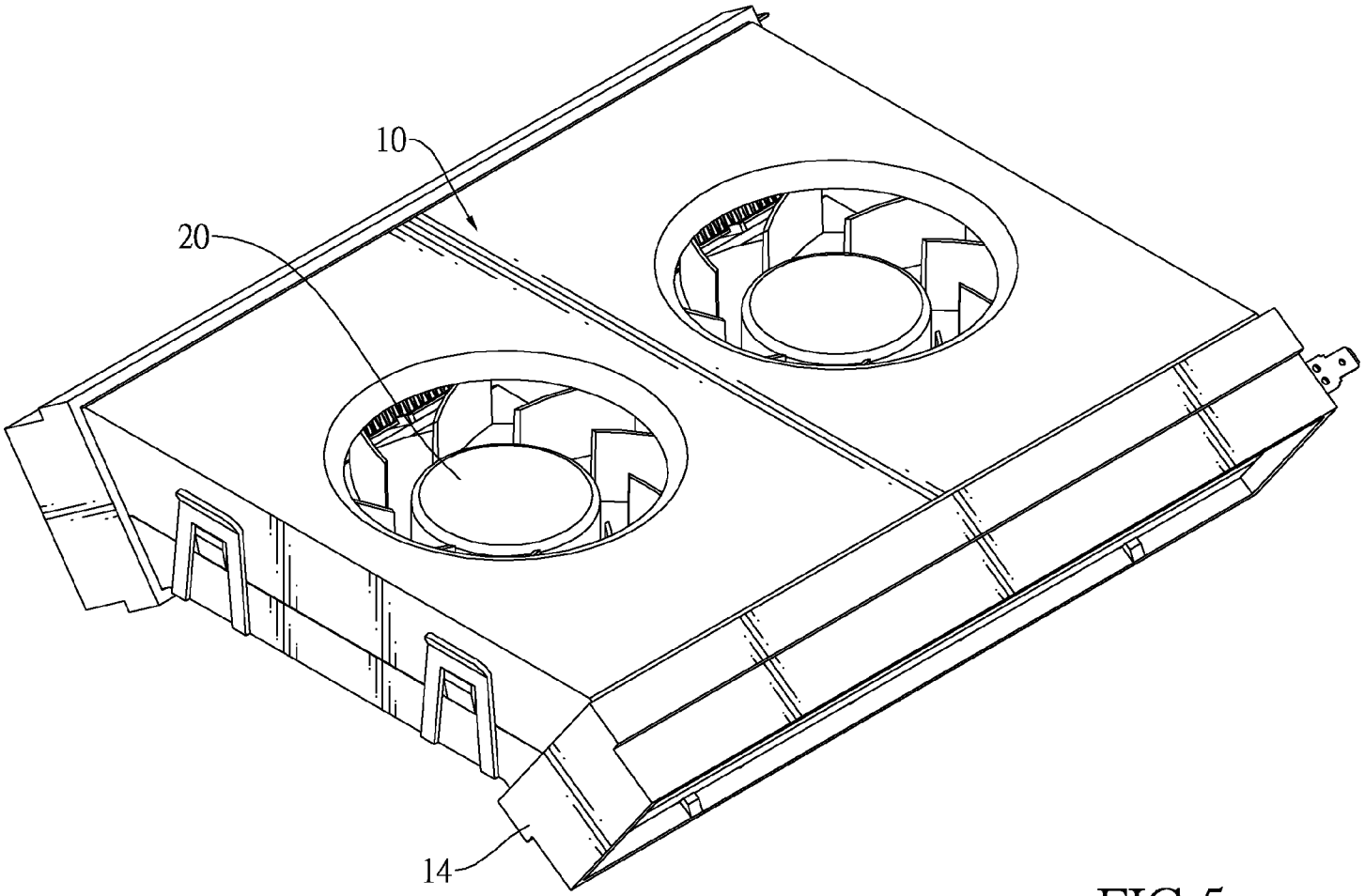
FIG. 5 is another perspective view of the core assembly in FIG. 3.

With reference to FIGS. 1 to 3, a heater in accordance with the present invention comprises an outer casing (100) and at least one core assembly (2).

Figure 8:
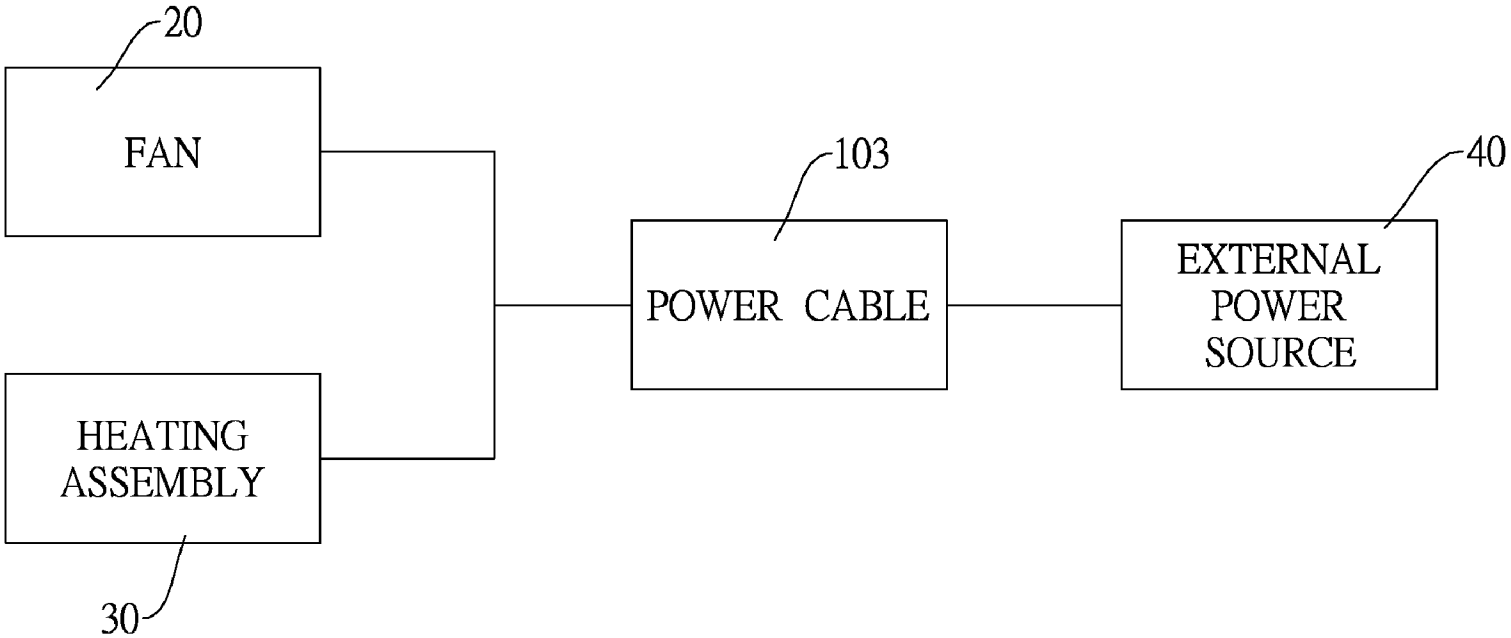
FIG. 8 is a block diagram of the heater in FIG. 1.

With reference to FIGS. 1, 2, and 8, the outer casing (100) is hollow and has an air inlet (101), two air outlets (102) and a power cable (103). The air inlet (101) is formed through a rear surface of the outer casing (100). The air outlets (102) are formed respectively through two sides of a front surface of the outer casing (100). The power cable (103) protrudes out from a bottom of the outer casing (100) and is connected electrically to an external power source (40).

Figure 7:
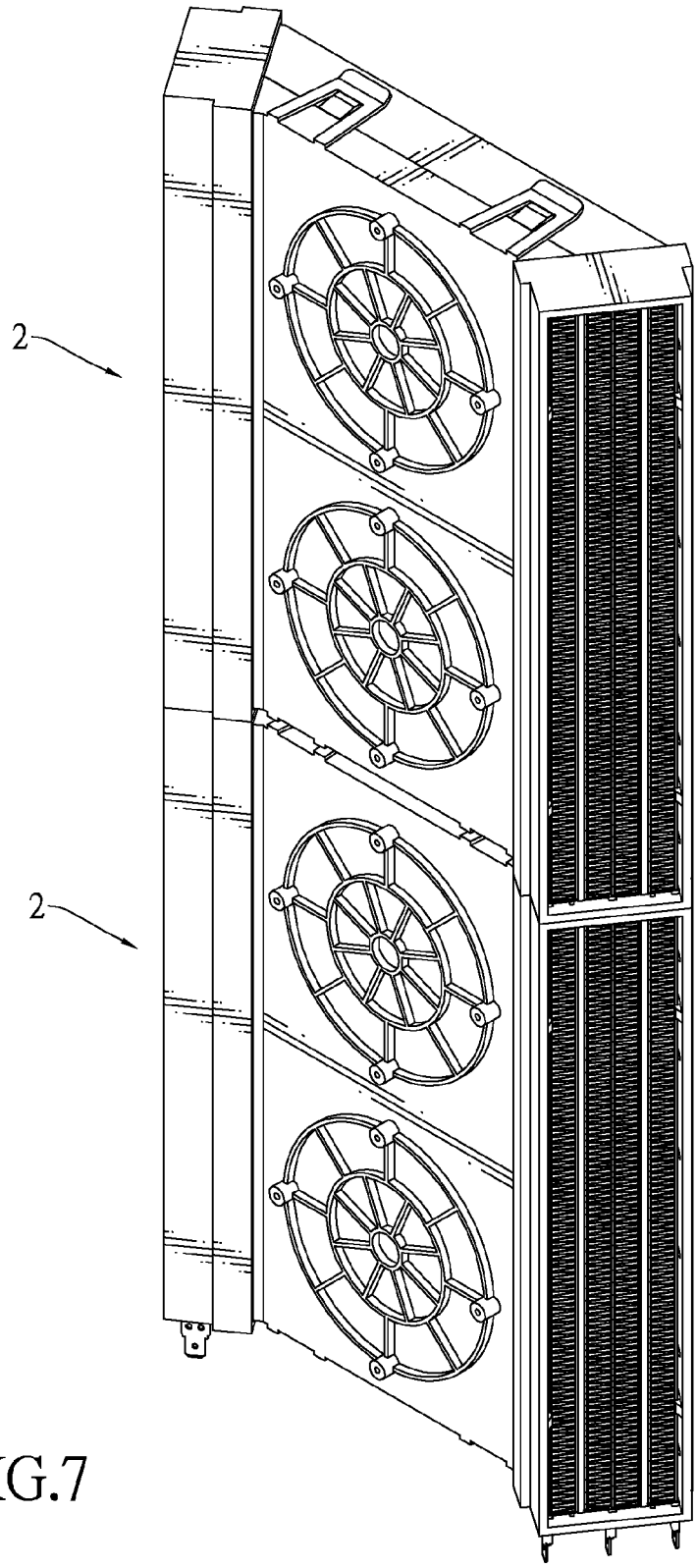
FIG. 7 is an operational perspective view of two core assemblies in FIG. 3 being vertically stacked one another.

With reference to FIGS. 2 to 5, each core assembly (2) is mounted in the outer casing (100) and has one inner casing (10), at least one fan (20) and two heating assemblies (30). With further reference to FIG. 7, the heater in accordance with the present invention comprises multiple stacked core assemblies (2).

The inner casing (10) is mounted in the outer casing (100). The inner casing (10) is hollow and may comprise two half casing bodies (104) attached to each other. The inner casing (10) has at least one air inlet (11), two air outlets (12), two guiding portions (13) and two connecting frames (14). Each air inlet (11) is formed through a rear surface of the inner casing (10) and corresponds to the air inlet (101) of the outer casing (100). The air outlets (12) are formed respectively through two sides of the inner casing (10) and respectively correspond to the air outlets (102) of the outer casing (100). The guiding portions (13) are formed obliquely on and respectively protrude around the air outlets (12) of the inner casing (10). The connecting frames (14) are respectively mounted securely around the corresponding guiding portions (13). The power cable (103) may protrude through the inner casing (10).

Each fan (20) is mounted rotatably in the inner casing (10). Each fan (20) corresponds to the air inlet (101) of the outer casing (100) and to one air inlet (11) of the inner casing (10). Each core assembly (2) may have multiple fans (20). In a preferred embodiment, each core assembly (2) has two fans (20). With further reference to FIG. 8, each fan (20) has a driving device and is connected electrically to the power cable (103). Each fan (20) may be a centrifugal fan. Each fan (20) draws air axially from the corresponding air inlets (101, 11) and blows air radially towards the air outlets (102, 12) at both sides.

With reference to FIGS. 2, 4, 6, and 8, the heating assemblies (30) are mounted respectively on the sides of the inner casing (10) and are connected electrically to the power cable (103). Each heating assembly (30) corresponds to one air outlet (102) of the outer casing (100) and one air outlet (12) of the inner casing (10). The heating assemblies (30) are located respectively at both sides of the fan (20) in a radial direction. Each heating assembly (30) may have a PTC (Positive Temperature Coefficient) ceramic heating component. Each heating assembly (30) may be mounted securely across a corresponding connecting frame (14).

Figure 6:
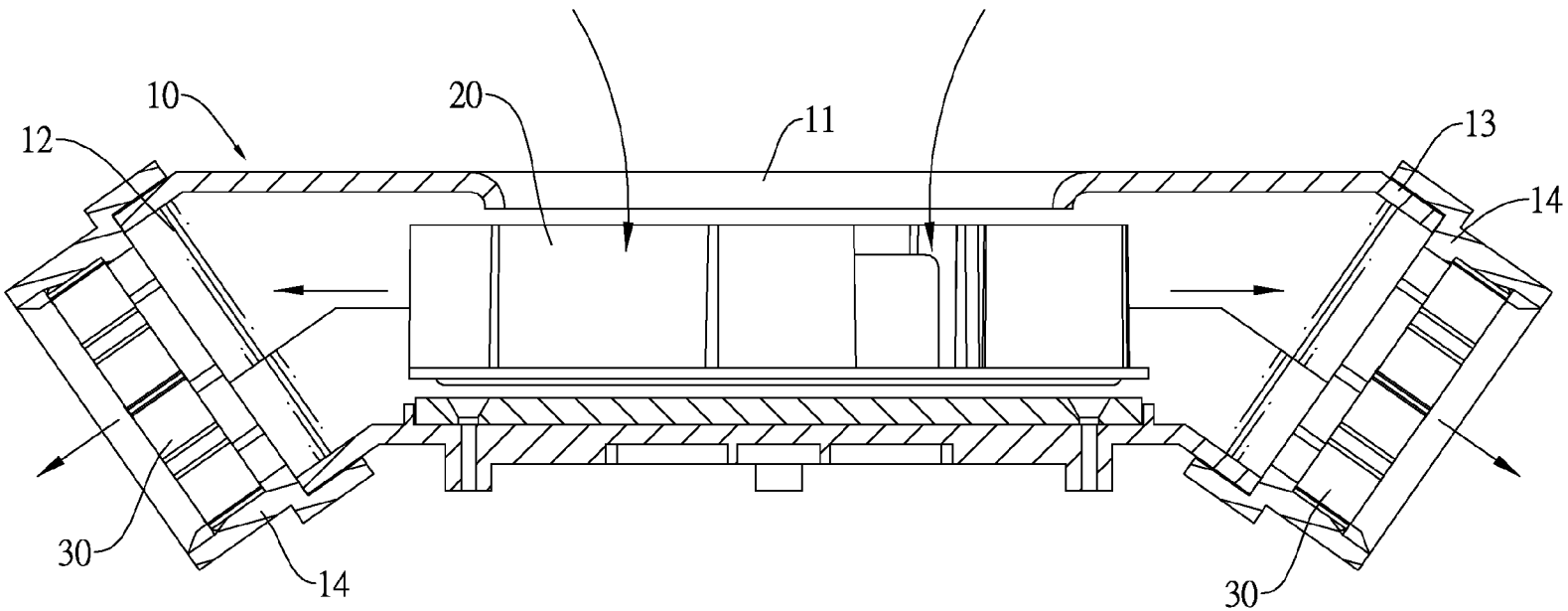
FIG. 6 is a cross-sectional top view of the core assembly in FIG. 3.

With reference to FIGS. 2 and 6, when the heater as described operates, the air is drawn axially through the air inlet (101) of the outer casing (100) and the air inlets (11) of the inner casing (10) via the rotation of the fans (20). Then the air is blown radially through the air outlets (12) of the inner casing (10), the heating assemblies (30) and the air outlets (102) of the outer casing (100) at both sides in sequence. Thus, the air is heated while passing through the heating assemblies (30) on both sides. Therefore, the warm air blows out from both sides of the outer casing (100) and warms air in two directions to warm ambient air. Consequently, convection speed is increased and the ambient air is warmed more effectively, which increases efficiency of heating the ambient air.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A heater comprising:

an outer casing having an air inlet formed through a rear surface of the outer casing;

two air outlets formed respectively through two sides of the outer casing; and a power cable mounted through the outer casing; and at least one core assembly mounted in the outer casing, and each one of the at least one core assembly having at least one fan connected electrically to the power cable, drawing air axially from the air inlet of the outer casing and blowing air radially towards the air outlets of the outer casing;

two heating assemblies mounted respectively in the sides of the outer casing, corresponding respectively to the air outlets and connected electrically to the power cable; an inner casing mounted in the outer casing and having one air inlet corresponding to the air inlet of the outer casing and two air outlets corresponding respectively to the air outlets of the outer casing;

the at least one fan is mounted rotatably in the inner casing; and the heating assemblies being mounted respectively on two sides of the inner casing and correspond respectively to the air outlets of the inner casing;

two connecting frames mounted respectively around the air outlets of the inner casing, each heating assembly being mounted securely across a corresponding connecting frame;

the inner casing of each one of the at least one core assembly further having two guiding portions formed obliquely on and protruding respectively around the air outlets of the inner casing; and each connecting frame being mounted securely around a corresponding guiding portion.

2. The heater as claimed in claim 1, wherein each heating assembly has a PTC ceramic heating component.

3. The heater as claimed in claim 1 comprising multiple core assemblies stacked on one another.

4. The heater as claimed in claim 1, wherein each heating assembly has a PTC ceramic heating component.

5. The heater as claimed in claim 4 comprising multiple core assemblies stacked on one another.

6. The heater as claimed in claim 5, wherein each core assembly has multiple fans; and the inner casing of each core assembly has multiple air inlets corresponding respectively to the fans.

7. The heater as claimed in claim 1 comprising multiple core assemblies stacked on one another.

8. The heater as claimed in claim 7, wherein each core assembly has multiple fans; and the inner casing of each core assembly has multiple air inlets corresponding respectively to the fans.

* * * * *